United States Patent [19]

Burton, III

[11] 3,952,801

[45] Apr. 27, 1976

[54] METHOD FOR IGNITING OIL SHALE RETORT

[75] Inventor: Robert S. Burton, III, Grand Junction, Colo.

[73] Assignee: Occidental Petroleum Corporation, Los Angeles, Calif.

[22] Filed: July 26, 1974

[21] Appl. No.: 492,593

[52] U.S. Cl. ..... 166/256; 166/59

[51] Int. Cl.[2] ..... E21B 43/24

[58] Field of Search ..... 166/59, 251, 256, 257, 166/259, 260, 261, 262, 300, 302

[56] References Cited

UNITED STATES PATENTS

| | | | |
|---|---|---|---|
| 2,801,089 | 7/1957 | Scott, Jr. | 166/260 X |
| 2,967,052 | 1/1961 | Crawford | 166/256 |
| 3,055,427 | 9/1962 | Pryor et al. | 166/260 |
| 3,072,189 | 1/1963 | MacSporran | 166/251 |
| 3,072,190 | 1/1963 | Reichle | 166/262 |
| 3,372,754 | 3/1968 | McDonald | 166/59 |
| 3,578,080 | 5/1971 | Closmann | 166/259 |

*Primary Examiner*—Stephen J. Novosad
*Assistant Examiner*—George A. Suckfield
*Attorney, Agent, or Firm*—Christie, Parker & Hale

[57] ABSTRACT

A technique is described for igniting the oil shale rubble pile in an in situ oil shale retort. A gas-air burner is lowered through a hole to a plenum over the oil shale to be ignited. An excess of air is passed through the hole and around the burner so that it is kept cool as the flame from it impinges on the rubble pile. The air also transfers heat downwardly into the rubble pile and provides oxygen for combustion of carbonaceous material in the shale. Preferably the burner is in a cylindrical housing having a flame exit at its lower end so that a hot flame is ejected downwardly.

7 Claims, 1 Drawing Figure

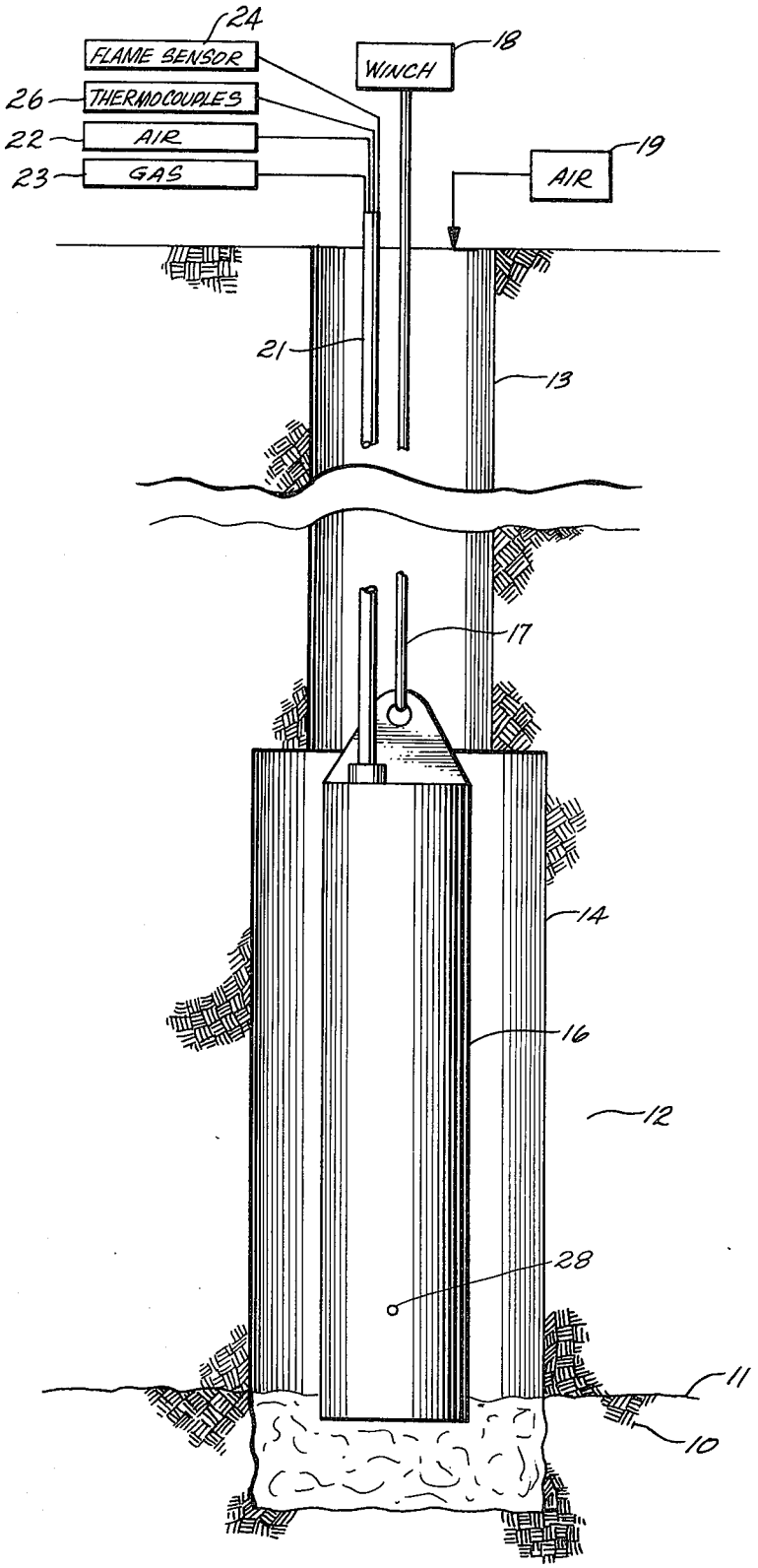
24
FLAME SENSOR
26
THERMOCOUPLES
22
AIR
23
GAS
WINCH
18
19
AIR
21
13
17
14
16
12
28
11
10

METHOD FOR IGNITING OIL SHALE RETORT

BACKGROUND OF THE INVENTION

There are vast deposits of oil shale throughout the world with one of the larger deposits being in the Piceance basin of Colorado, Wyoming and Utah. This oil shale has carbonaceous materials known as kerogen which decomposes on heating to produce shale oil which approximates crude petroleum. The vast oil shale deposits represent a very large source of oil for the world energy economy.

A variety of techniques have been proposed for extracting the shale oil at economical prices. Many of these techniques mine the oil shale by underground or open pit mining and carry it to large retorts where it is heated and the oil extracted. These approaches involve moving massive amounts of material to the retorts and disposing of enormous quantities of spent shale from which the carbonaceous values have been extracted.

Another approach which has significant economic advantages and minimal impact on the environment employs in situ retorting where the shale oil is removed without mining all of the oil shale. Such retorts can be formed, for example, by excavating a portion of rock in a volume that ultimately will become an underground retort. The balance of the rock in the volume to become a retort is then explosively expanded to form a rubble pile of oil shale particles substantially completely filling the retort volume. The original excavated volume is thus distributed through the expanded oil shale particles as the void volume therebetween.

Oil is then extracted from the expanded rubble pile in the underground retort by igniting the top of the rubble pile and passing an oxygen bearing gas, such as air, downwardly through the retort. Once raised to a sufficient temperature the oil shale will support combustion, initially at the top of the retort by burning some of the oil in the shale. Thereafter, as the oil is extracted there is residual carbon left in the shale and, when at a sufficient temperature, this too will react with oxygen to burn and supply heat for retorting. This burning of residual carbon in the shale depletes oxygen from the air being passed down through the retort and the substantially inert gas then carries heat to a retorting zone below the combustion zone for decomposing the kerogen and extracting oil. Gases from the bottom of the retort are collected and often contain sufficient hydrogen, carbon monoxide and/or hydrocarbons to be burnable in heat engines. Oil is also collected at the bottom of the retort and transported for conventional refining.

When the oil shale is expanded in the underground retort, the particles ordinarily fill the entire volume so that there is no significant void space above the rubble pile. Air for combustion can be brought to the rubble pile by means of holes bored through overlying intact rock. Appreciable difficulty may be encountered, however, in igniting the top of the rubble pile to support combustion. Ignition requires a substantial amount of heat delivered over a sufficient time to raise the oil shale above its ignition temperature. Considerable difficulty is encountered in heating a substantial volume of oil shale and assuring that ignition has been obtained.

BRIEF SUMMARY OF THE INVENTION

There is, therefore, provided in practice of this invention according to a presently preferred embodiment, a technique for igniting a retort by forming an enlarged plenum at the bottom of a borehole adjacent the top of the rubble pile in the retort and lowering a burner through the bore hole into the plenum. A combustible mixture is burned in the burner so that a flame is directed downwardly. A quantity of air is forced through the plenum for driving heat downwardly into the bed of oil shale, keeping the burner cool and supplying oxygen for combustion of carbonaceous material in the oil shale.

DRAWING

These and other features and advantages of the present invention will be appreciated as the same becomes better understood by reference to the following detailed description of a presently preferred embodiment when considered in connection with the accompanying drawing which illustrates in longitudinal cross section a burner in place adjacent an oil shale rubble pile in an in situ retort. A suitable burner is also shown in my co-pending application Serial No. 492,600, filed July 26, 1974, and assigned to the assignee of this application.

DESCRIPTION

The drawing illustrates in vertical cross-section and partly schematically a burner arrangement for igniting a rubble pile in an in situ oil shale retort. Only the very uppermost portion of the retort volume 10 is indicated. This retort volume is simply cross hatched as earth, however it will be understood that the volume is filled with irregularly shaped particles of expanded oil shale, ordinarily fragmented by detonation of explosives. Above the ceiling 11 of the retort volume there is an overburden of intact rock 12. The thickness of this overburden is arbitrary and may be a few tens of feet in some retorting arrangements and may be hundreds of feet in others.

A cylindrical hole 13 is bored through the overburden 12 to the top of the rubble pile. This hole may be formed either before or after blasting to form the rubble pile of expanded shale, but is usually made subsequent to blasting. Such a hole may be made by conventional drilling techniques and reamed out to the desired size. If some or all of the overburden is permeable the hole may be cased with steel pipe or the like, and it is to be understood that reference herein to a hole includes either a simple bore through intact rock or a cased bore hole.

A larger diameter plenum 14 is formed at the lower end of the hole 13 with its lower end in communication with the top of the rubble pile. This plenum may extend below the ceiling 11 into the rubble for some distance, however, a principal portion of the plenum will ordinarily be formed in intact rock to assure that the plenum remains open. If a hole of any substantial height is formed in the rubble pile the irregular pieces of rock may collapse into the hole and block it. It is therefore, generally undesirable to form any great length of the plenum 14 in the rubble pile itself. Some of the plenum is desirable in the rubble pile to assure fluid communication with appreciable void volume between the oil shale particles and minimize air flow resistance. The larger the cross-section of the plenum, the less need be in the rubble pile for these purposes.

Such a plenum may be formed prior to blasting to form the rubble pile, however, the uncertainty that it will remain intact is such that it is preferable to form the plenum after blasting. If it is formed prior to blasting it should be inspected to assure that an appropriate plenum remains after blasting. Inspection can be by remote TV, for example. The plenum is typically formed by lowering a conventional expanding underreamer or chambering tool down the hole 13 and reaming out an enlarged diameter. An appreciably enlarged plenum can be formed in this manner. For example, with a 10 inch diameter bore hole 13, a plenum in the range of 17 to 27 inches can be made with conventional tools. The length or height of the plenum need be only sufficient to accommodate a burner lowered therein and assure that particles of rubble do not sufficiently block the lower end of the plenum to inhibit the passage of combustion air therethrough.

After a suitable plenum is assured, a burner 16 is lowered down the hole by cable 17 connected to a winch 18 above the overburden. Preferably, the burner is lowered to a point that it is substantially completely in the plenum so that there is no obstruction of the hole 13 which would inhibit the passage of air therethrough. This is not necessary in all cases and if small enough diameter, the upper portions of the burner can be in the hole 13 without unduly constricting air flow. Further, the quantity of air needed during ignition of the rubble pile may be less than needed during retorting thereof. Air is forced down the hole 13 into the rubble pile from any conventional blower or other air supply 19, indicated schematically in FIG. 1.

A "utility" umbilical 21 is connected to the burner 16 and extends up the hole 13 for operation of the burner. Compressed air 22 and a combustible gas 23 are fed down hoses in the umbilical for combustion in the burner. Propane, butane, natural gas, flue gas from oil shale retorting, or other combustible materials such as oil can conveniently be used. It will also be apparent, of course, that oxygen enriched air or mixtures of air and retorting flue gas can be used for either air supply 19 or 22.

A conventional flame sensor 24 is also connected to the burner to assure that ignition of the combustible gases has occurred and that heating of the oil shale is proceeding. Thermocouples may also be provided in the burner and a thermocouple measuring circuit 26 is also connected through the umbilical 21. The thermocouples in the burner monitor the temperature near the lower end where the most severe heating is encountered. This permits the operator to reduce the air and fuel supply to the burner to lower the rate of heat generation of, if desired, to increase the quantity of air flowing down the hole and around the burner to provide additional cooling.

A strong flame is directed out of the lower end of the burner to impinge on the top of the rubble pile in the oil shale retort. This burning is conducted until a substantial volume of oil shale has been heated above its ignition temperature so that the combustion in the rubble pile is self sustaining. This vast amount of heat would rapidly destroy the burner and elements within it if steps were not taken to keep it cool. Air from the supply 19 is therefore forced down the hole at a sufficient rate that the cool air flow around the burner 16 maintains it at a safe operating temperature.

It is also desirable to force some of the air from the air supply 22 into the upper portion of the burner 16 for cooling the interior. A hole or holes 28 near the bottom of the burner discharge this additional cooling air into the region surrounding the burner. This air mixes with the air forced down the hole 13. This internal cooling of the burner with air that is mixed with the air surrounding it significantly reduces the internal temperature of the burner.

It will be noted that the secondary air passed down the hole around the burner provides the oxygen for combustion of the carbonaceous material in the oil shale heated by the burner. It also carries heat of the flame into the bed of oil shale particles for heating a substantial volume of the bed. As heating of the shale continues, a greater portion of the total heat adjacent the top of the retort comes from combustion of carbonaceous materials as compared with the quantity of heat from the burner and eventually the combustion in the retort becomes self sustaining. At this point the burner can be turned off and withdrawn from the hole and retorting conducted in the normal manner with air or other gas passed down the hole 13.

Although but a single embodiment of this invention has been described and illustrated herein, many modifications and variations will be apparent to one skilled in the art. Thus, for example if a substantial area of retort is involved it may be preferable to have a plurality of bore holes to the top of the rubble pile, each with a plenum so that ignition is obtained at several points and the distance for lateral propagation of the flame front in the retort is minimized. Techniques other than the described reaming may be used for forming the plenum at the top of the rubble pile. Many other modifications and variations will be apparent to one skilled in the art and it is therefore to be understood that within the scope of the appended claims the invention may be practiced otherwise than as specifically described.

What is claimed is:

1. A method for igniting a rubble pile of expanded oil shale in an in situ oil shale retort comprising the steps of:

forming an in situ oil shale retort containing a rubble pile of fragmented oil shale;

boring a hole to the top of the rubble pile;

underreaming a region at the bottom of the hole after forming the rubble pile for forming a plenum at the bottom of the hole adjacent the area of the rubble pile to be ignited, the plenum having a larger cross section than the hole;

lowering a burner through the hole at least part way into the plenum;

burning a mixture of combustible material and oxidizing gas in the burner and directing a flame towards the rubble pile; and forcing a quantity of oxidizing gas through the hole into the plenum around the burner for cooling the burner, carrying heat downwardly into the shale, and providing oxygen for combustion of carbonaceous material in the oil shale.

2. A method as defined in claim 1 wherein the forming step comprises forming at least a portion of the plenum in the rubble pile of oil shale in the retort.

3. A method as defined in claim 1 further comprising the step of forcing a quantity of gas through the interior of the burner for cooling thereof and discharging the gas from the burner into the oxidizing gas around the burner.

4. A method as defined in claim 1 further comprising the step of forcing a quantity of oxidizing gas through the interior of the burner and discharging it from the lower portion thereof into the oxidizing gas around the burner in the plenum.

5. A method for igniting carbonaceous materials in fragmented oil shale particles in an in situ oil shale retort comprising the steps of:

forming a hole to the in situ oil shale retort;

positioning a burner in the hole for directing the burner's flame out of the burner towards the oil shale particles and such that gas flow around the burner is not inhibited;

introducing combustible material and oxidizing gas into the burner;

igniting the combustible material and oxidizing gas for forming the burner's flame;

introducing air into the in situ oil shale retort through the hole around the burner for driving heat from the burner into the in situ oil shale retort, for maintaining the burner at a temperature below the destruction temperature of the burner and for supplying oxygen for combustion of carbonaceous material in the oil shale; and forcing a portion of the oxidizing gas into an interior portion of the burner for additional cooling of the burner and discharging said portion of the oxidizing gas into the air around the burner.

6. A method as defined in claim 5 comprising forming the hole to the top of the in situ oil shale retort.

7. A method as defined in claim 5 further comprising enlarging at least the lower portion of the hole adjacent the top of the in situ retort after forming the retort and positioning the burner in the enlarged portion.

* * * * *